US009650780B2

(12) United States Patent
Tan

(10) Patent No.: US 9,650,780 B2
(45) Date of Patent: May 16, 2017

(54) HANGER BRACKET

(71) Applicant: MiTek Holdings, Inc., Wilmington, DE (US)

(72) Inventor: Robert Tan, Dandenong South (AU)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 14/265,006

(22) Filed: Apr. 29, 2014

(65) Prior Publication Data

US 2014/0318076 A1 Oct. 30, 2014

(30) Foreign Application Priority Data

Apr. 29, 2013 (AU) ..... 2013205474

(51) Int. Cl.
*E04C 5/00* (2006.01)
*E04B 1/26* (2006.01)

(52) U.S. Cl.
CPC ..... *E04B 1/2608* (2013.01)

(58) Field of Classification Search
CPC .... E04B 1/2608; E04B 7/063; E04H 12/2253
USPC ..... 52/712, 715, 713, 655.1, 657, 92.1, 92.2
See application file for complete search history.

(56) References Cited

U.S. PATENT DOCUMENTS 625,427 A * 5/1899 Stewart et al. ..... F16B 7/0446 182/87
828,488 A * 8/1906 Lanz ..... 29/897.3
1,657,243 A * 1/1928 Daniels ..... 403/190
3,333,875 A * 8/1967 Tracy ..... 403/170
3,423,898 A * 1/1969 Tracy et al. ..... 52/713
4,047,352 A * 9/1977 Sweet ..... E04B 1/19 52/693
4,209,265 A 6/1980 Moehlenpah
4,523,412 A 6/1985 Sielaff
4,527,375 A * 7/1985 Braginetz ..... E04B 1/2608 403/232.1
4,713,923 A 12/1987 Sielaff et al.
4,782,641 A 11/1988 Manenti et al.
4,897,979 A * 2/1990 Colonias ..... 52/643
5,004,369 A 4/1991 Young
5,217,317 A 6/1993 Young
5,230,198 A 7/1993 Callies
5,236,273 A * 8/1993 Gilb ..... 403/232.1
5,253,465 A * 10/1993 Gilb ..... 52/643
(Continued)

OTHER PUBLICATIONS

Australian Patent Examination Report No. 1 for Application No. 2013205474 dated Dec. 15, 2015, 3 pages.
(Continued)

*Primary Examiner* — Basil Katcheves
(74) *Attorney, Agent, or Firm* — Senniger Powers LLP

(57) ABSTRACT

A hanger bracket for mounting a skewed beam at a junction of two adjacent beams includes a supporting section configured to support the skewed beam. Fixing flanges are substantially perpendicular to the supporting section and are configured for attaching the bracket to the adjacent beams. The fixing flanges lie in different planes to each other. Reinforcing faces are located between the supporting section and each of the fixing flanges. The reinforcing faces are inclined relative to the supporting section and fixing flanges. The hanger bracket includes holes in the supporting section or reinforcing faces configured to secure the skewed beam to the hanger bracket.

17 Claims, 5 Drawing Sheets

(56) References Cited

U.S. PATENT DOCUMENTS

| | | | | |
|---|---|---|---|---|
| 5,274,981 | A * | 1/1994 | Commins | 52/712 |
| 5,380,116 | A * | 1/1995 | Colonias | 403/232.1 |
| 5,528,875 | A * | 6/1996 | Ziegler et al. | 52/702 |
| 5,553,961 | A | 9/1996 | Olden | |
| 5,560,156 | A * | 10/1996 | McDonald | 52/92.2 |
| 5,564,248 | A | 10/1996 | Callies | |
| 5,603,580 | A * | 2/1997 | Leek et al. | 403/232.1 |
| 5,653,079 | A | 8/1997 | Loeffler et al. | |
| 5,857,306 | A | 1/1999 | Pellock | |
| D414,400 | S | 9/1999 | Williams | |
| 5,983,589 | A | 11/1999 | Daudet | |
| D419,430 | S | 1/2000 | Williams | |
| 6,022,165 | A * | 2/2000 | Lin | 403/231 |
| 6,254,306 | B1 | 7/2001 | Williams | |
| 6,295,781 | B1 * | 10/2001 | Thompson | 52/712 |
| 6,334,287 | B1 * | 1/2002 | Fick | 52/745.11 |
| 6,401,422 | B1 | 6/2002 | Olden | |
| 6,427,416 | B1 | 8/2002 | Rassel | |
| 6,463,711 | B1 | 10/2002 | Callies | |
| 6,513,298 | B2 | 2/2003 | Rassel | |
| 7,134,252 | B2 * | 11/2006 | Thompson | 52/712 |
| 7,178,305 | B2 | 2/2007 | Petrova | |
| 7,254,919 | B2 | 8/2007 | Lutz et al. | |
| 7,334,372 | B2 * | 2/2008 | Evans et al. | 52/289 |
| 7,631,463 | B2 | 12/2009 | Greenlee et al. | |
| 7,913,472 | B2 * | 3/2011 | Troth et al. | 52/696 |
| 8,245,479 | B2 | 8/2012 | Gannon et al. | |
| 8,307,583 | B2 | 11/2012 | Keys et al. | |
| 8,387,333 | B2 | 3/2013 | Brekke | |
| 2004/0079044 | A1 * | 4/2004 | Troth et al. | 52/696 |
| 2010/0166497 | A1 * | 7/2010 | Vilasineekul | E04B 1/2604 403/205 |
| 2012/0297724 | A1 | 11/2012 | Pope et al. | |

OTHER PUBLICATIONS

Australian Patent Examination Report No. 2 for Application No. 2013205474 dated May 20, 2016, 3 pages.

* cited by examiner

HANGER BRACKET

FIELD OF THE DISCLOSURE

This invention relates to a hanger bracket for mounting a beam at a junction of two adjacent beams, particularly for mounting a skewed beam between two adjacent beams.

BACKGROUND

Trusses used in building constructions largely comprise roof trusses and floor trusses. To achieve a variety of building frame designs truss-to-truss connections can be perpendicular and also skewed. In roof trusses a skewed truss is used to form a 'hip' roof and the roof trusses are known as hip trusses. The trusses in a 'hip' roof are designed such that, at a junction of two trusses, there is a third truss which intersects the junction at an angle. Generally, the junction between adjacent beams in a hip roof is a perpendicular junction between the two adjacent beams. Such trusses are found not only in hip roof trusses, but could also apply to floor trusses supporting a skewed floor truss or any other trusses fixed at an angle to a junction, and are referred to herein as a 'skewed truss'. Such connections are therefore made at a junction of two beams, where a third beam intersects the junction at an angle.

There are standard techniques for mounting a skewed truss or beam in-between a perpendicular truss and a girder truss. One technique is to mount both the skewed truss and the perpendicular truss using a single bracket. When using a single bracket the weight of the skewed truss and the perpendicular truss are supported by the bracket, which is fixed to the girder truss. The skewed truss is secured in position on the bracket and between the girder truss and perpendicular truss by a tie that is nailed to the skewed truss. The disadvantage of this method is that the bracket is not necessarily optimised for the purpose of supporting a skewed truss, resulting in the securing method being unstable and the bracket being oversized. Furthermore, heavy loads from skewed trusses can lead to deflection of brackets.

There also exist fixed angle brackets for mounting to a girder truss that allow both a perpendicular and a skewed truss to be mounted. However, each bracket is restricted to a single angle at which the skewed truss can be mounted, and have complex geometry to accommodate mounting multiple trusses.

Another technique for mounting a skewed truss or beam is to first mount the perpendicular truss to the girder truss with a first bracket, and then use a supplementary bracket, known as a hanger bracket, to mount the skewed truss. The supplementary bracket relies on the perpendicular truss connection to already be made, at least in part, by the first bracket. The supplementary hanger bracket is then mounted to the already constructed perpendicular connection, and the skewed truss, supported on the hanger bracket, is secured thereto from underneath through one or more holes in the bottom of the hanger bracket. This technique is effective in securing the hip truss to the hanger bracket; however, the supplementary bracket has been known to deflect under loads, resulting in shifting of the skewed truss. Another disadvantage of the supplementary bracket method is that the head of the fixing screw can interfere with the plasterboard ceiling, which is mounted directly onto the underside of the truss or beam.

The current methods and products for attaching a skewed beam, while effective, could be improved.

SUMMARY

In accordance with the invention there is provided a hanger bracket for mounting a skewed beam at a junction of two adjacent beams, comprising: a supporting section configured to support the skewed beam; fixing flanges substantially perpendicular to the supporting section configured for attaching the bracket to the adjacent beams, the fixing flanges lying in different planes to each other; reinforcing faces located between the supporting section and each of the fixing flanges, wherein the reinforcing faces are inclined relative to the supporting section and fixing flanges; and holes in the supporting section or reinforcing faces configured to secure the skewed beam to the hanger bracket.

In an embodiment of the invention the reinforcing faces are structured to bear the load of the skewed beam. In some embodiments the reinforcing faces form a diagonal inclination between the support section and the fixing flanges. In further embodiments, the reinforcing faces are inclined at obtuse angles relative to the supporting section and fixing flanges.

In a further embodiment the supporting section has one or more holes through which the skewed beam is secured to the hanger bracket.

In another embodiment of the current invention the reinforcing faces have one or more holes through which the skewed beam is secured to the hanger bracket and, in some embodiments, the supporting section defines a lowermost plane of the bracket and holes in the securing faces are positioned above the lowermost plane.

In yet a further embodiment of the invention the reinforcing faces are inclined relative to the supporting section at an inclination angle of between 5° and 85°, and preferably between 30° and 60°.

In an embodiment each reinforcing face is substantially triangular, whereby the supporting section is connected along one side of the triangle and a fixing flange is connected along another side of the triangle.

In order to use the bracket in combination with different girder brackets, the fixing flanges may, in one aspect, have groups of fixing holes where each group corresponds to overlap with the fixing holes of different girder brackets, over which the hanger bracket can be fixed.

The hanger bracket is preferably formed by folding a blank of sheet metal that has been cut to shape, and that may have been first pre-punched, pre-lasered or pre-drilled with fixing holes.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
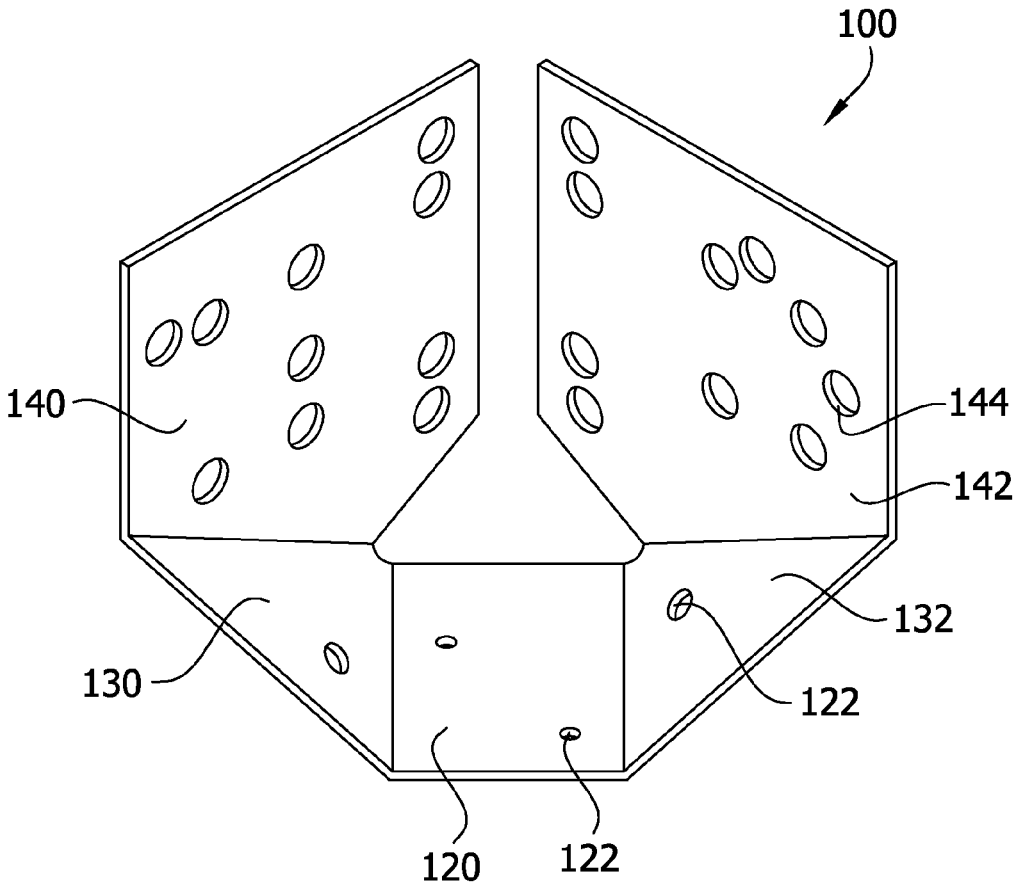
FIG. 1 is an isometric view of a hanger bracket in accordance with an embodiment of the invention.

FIGS. 1 to 5*d* illustrate a hanger bracket 100 for mounting a skewed beam 600 at a junction of two adjacent beams. FIGS. 5*a* to 5*d* show the two beams which form the junction as perpendicular beams 400, 500.

The hanger bracket 100 comprises a horizontal supporting section 120 to support a skewed beam 600 and fixing flanges 140, 142, that attach the hanger bracket 100 to the perpendicular beams 400, 500. Fixing flanges 140, 142 attach to vertical faces of adjacent beams 400, 500 so that supporting section 120 lies horizontally to support the load of skewed beam 600. The spatial planes in which the fixing flanges lie are different to each other as the fixing flanges are intended to fix to adjacent beams that lie in different planes, and namely that meet at an angled junction, such as the perpendicular junction illustrated. It is however understood that the junction could be formed at any angle greater than 0° and less than 180°, and hence the fixing flanges 140 also lie in planes that are angled at greater than 0° and less than 180°

Reinforcing faces 130, 132 located between the supporting section 120 and each of the fixing flanges 140, 142 are inclined relative thereto and connect the supporting section 120 to each of the perpendicular fixing flanges 140, 142. The supporting section 120 and/or reinforcing faces 130, 132 also have one or more securing holes 122 through which the skewed beam 600 can be secured to the hanger bracket 100 using screws 700. The screws 700 used for securing the skewed beam 600 may have a countersunk head, capable of being recessed into the supporting section 120, in order to avoid protrusion of the head of the screw into the plasterboard ceiling.

In this description it is understood that the term 'skewed beam' can also refer to a skewed truss, such as a 'hip truss', or any other structural component to be joined to another structural component at an angle other than 90° or a straight connection.

Figure 2A:
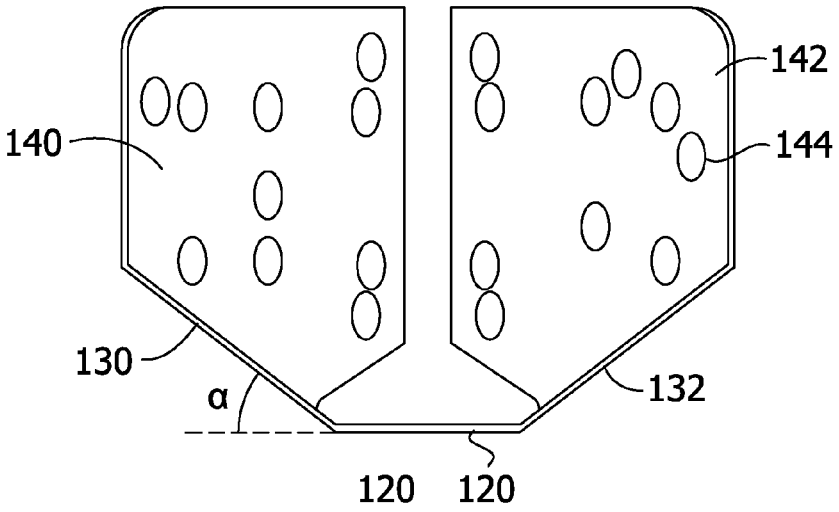
FIG. 2*a* is a front view of the hanger bracket without mounting or securing holes shown.
Figure 2B:
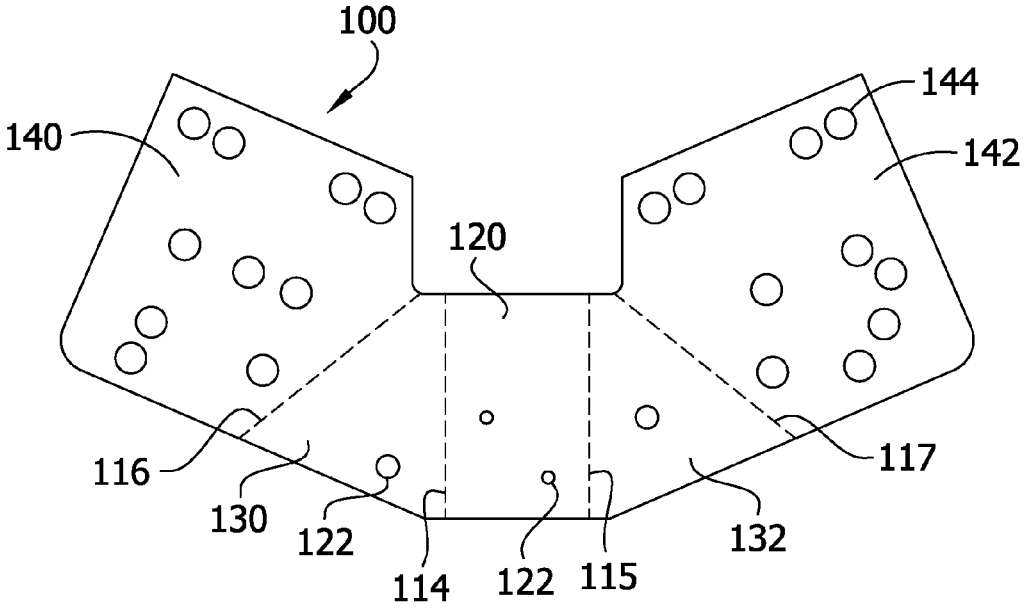
FIG. 2*b* is a plan view of the blank with the fold lines denoted.
Figure 3:
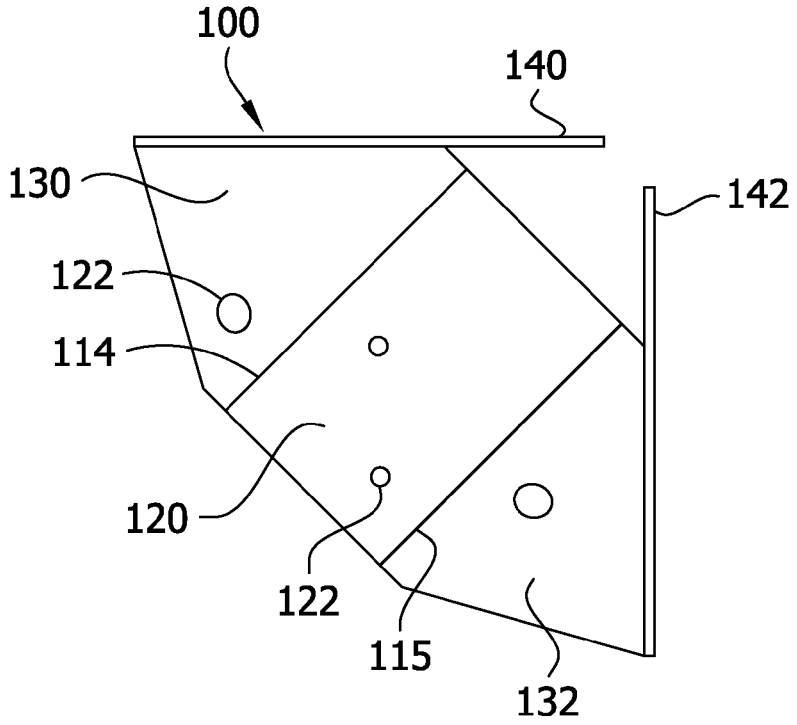
FIG. 3 is a plan view of the bracket.
Figure 4:
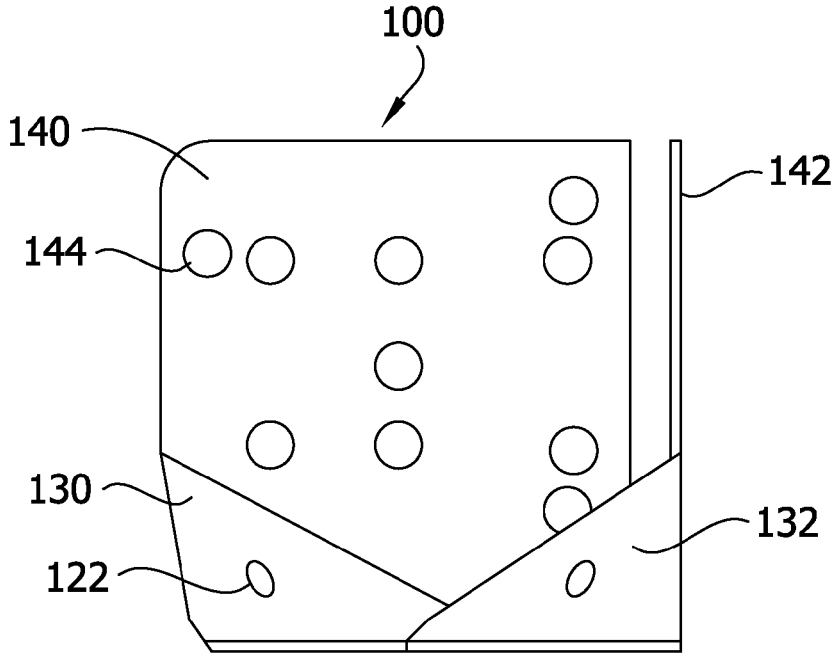
FIG. 4 is a side view of the bracket.

Referring to FIGS. 2*a* and 2*b*, the supporting section 120 may be substantially the same width as the skewed beam 600, reducing the likelihood of deflection of the supporting section 120 due to the weight of the beam 600. Furthermore, by connecting the fixing flanges 140, 142 to the supporting section 120 by the most direct path the reinforcing faces 130, 132 form rigid struts that bear the load of the skewed beam 600 and strengthen the hanger bracket 100. This is achieved by having a diagonal inclination angle a between the supporting section 120 and the fixing flanges 140, 142. The angles between the fixing flanges 140, 142 and the reinforcing faces 130, 132 are obtuse angles. Furthermore, the angles between the reinforcing faces 130, 132 and the supporting section are obtuse angles.

Referring to FIGS. 1, 2*a*, 3 and 4, when using the securing holes 122 of the reinforcing faces 130, 130 the screws 700, or other fasteners such as bolts or nails, are used to secure the skewed beam 600 in a manner whereby the screws 700 do not protrude into the plasterboard ceiling that is mounted directly onto the underside of the beams. This is achieved by positioning the securing holes 122 in the reinforcing faces 130, 132 higher than the supporting section 120 which supports the skewed beam 600, and namely higher than a lowermost plane in which the supporting section 120 lies, so that the screws 700 enter at an angle and the heads of the screws 700 do not protrude lower than the supporting section 120, or the lowermost plane.

It is understood that the invention will function using either the securing holes 122 of the supporting section 120 or the securing holes 122 of the reinforcing faces 130, 132. As such, choosing to only include only one set of securing holes 122 would not deviate from the scope of the invention.

Figure 5A:
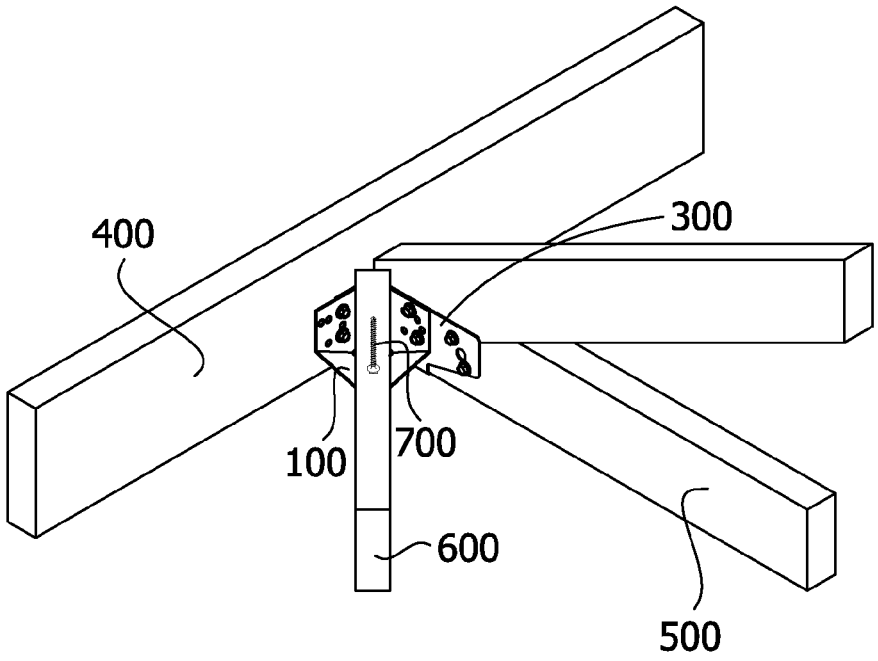
FIG. 5*a* is an isometric view of the bracket in use mounted to a small girder bracket, with the skewed beam secured from underneath.
Figure 5B:
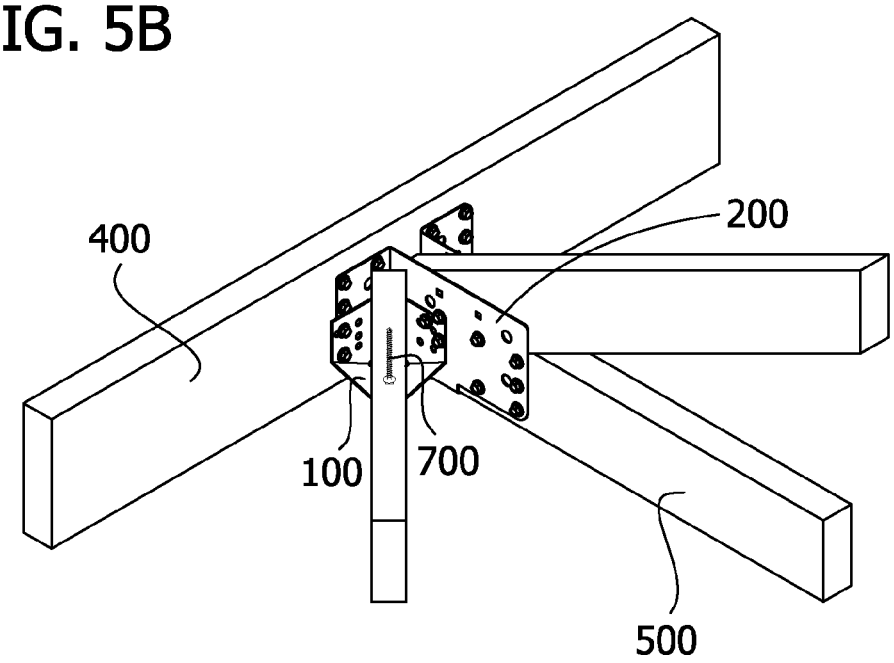
FIG. 5*b* is an isometric view of the bracket in use mounted to a large girder bracket, with the skewed beam secured from underneath.
Figure 5C:
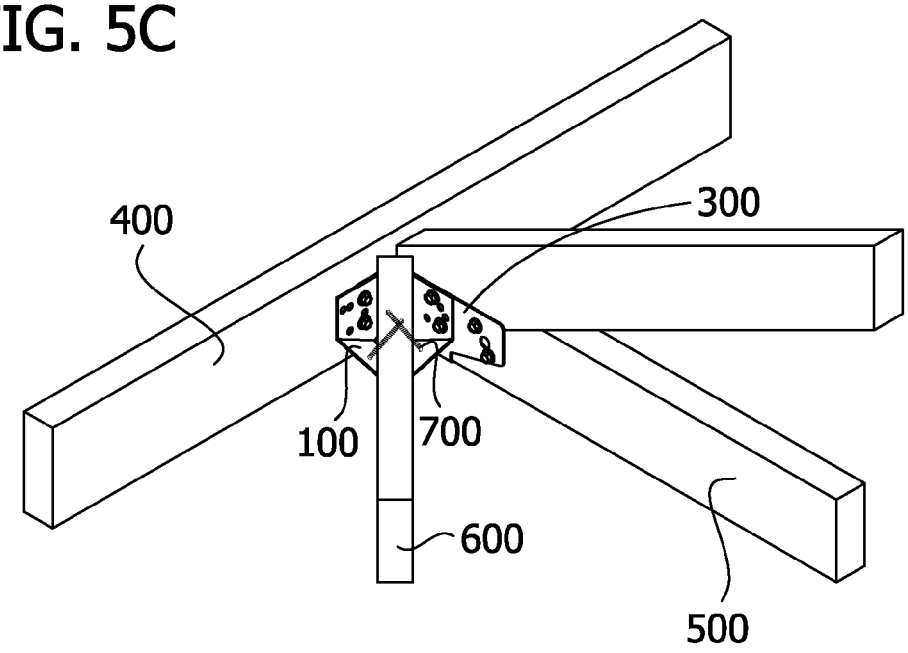
FIG. 5*c* is an isometric view of the bracket in use mounted to a small girder bracket, with the skewed beam secured from the sides.
Figure 5D:
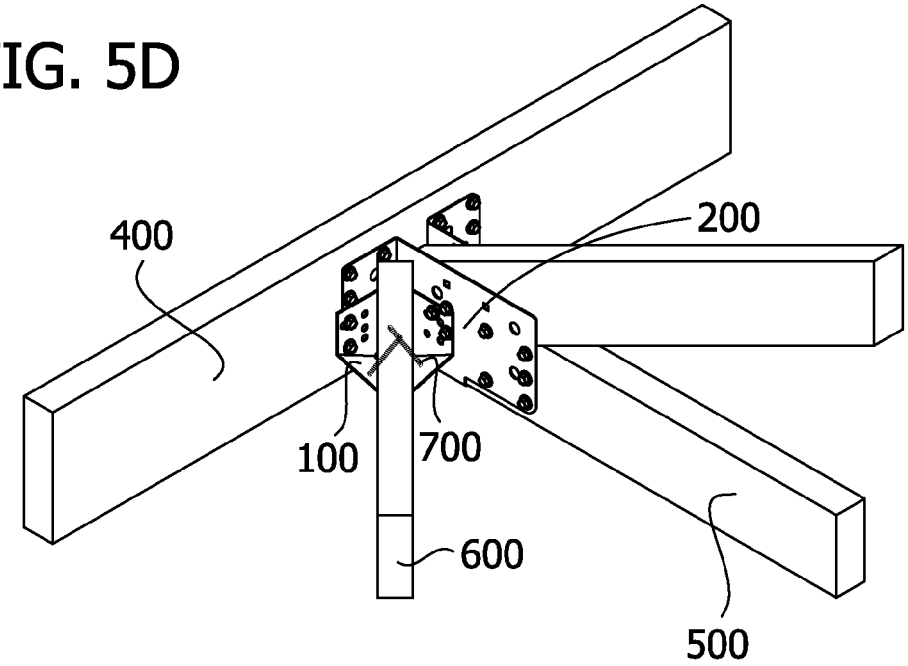
FIG. 5*d* is an isometric view of the bracket in use mounted to a large girder bracket, with the skewed beam secured from the sides.

The hanger bracket 100 is typically used as a secondary bracket, or supplementary bracket, in conjunction with a girder bracket. Illustrated in FIGS. 5*a* to 5*d* is a hanger bracket 100 used in conjunction with a large girder bracket 200 or a small girder bracket 300, in order to support and secure a skewed beam 600 (forming the lower chord of a 'hip truss') between perpendicular beams 400, 500. FIGS. 5*a* and 5*b* show securing the skewed beam 600 through securing holes 122 in the supporting section 120. FIGS. 5*c* and 5*d* show the skewed beam 600 secured through securing holes 122 in the reinforcing faces 130, 132.

The fixing flanges 140, 142 of the hanger bracket 100 each have a number of fixing holes 144. As shown in FIGS. 5*b* and 5*d* the fixing holes 144 of the hanger bracket 100 are positioned such that the fixing holes 144 align with mounting holes in larger girder bracket 200. FIGS. 5*a* and 5*c* illustrate the hanger bracket 100 mounted over a small girder bracket 300, with fixing holes 144 of the hanger bracket 100 aligning with the mounting holes of the small girder bracket 300. In this embodiment of the hanger bracket 100 the fixing holes 144 in the fixing flanges 140, 142 include a group of holes for alignment with the large girder bracket 200 and a group of holes for alignment with the small girder bracket 300. It is understood that fixing holes 144 need not align with more than one girder bracket 200, 300 and could be arranged to only align with one size or one manufacturer's girder bracket. Additionally, it is also understood that the fixing holes 144 could be positioned to align with other brackets.

As shown in FIGS. 5*b* and 5*d* the hanger bracket 100 is fixed to the perpendicular beams 400, 500 by screws which extend through the fixing holes 144 in the fixing flanges 140, 142 and through the mounting holes of the large girder bracket 200. FIGS. 5*a* and 5*c* illustrate a similar situation, in which the hanger bracket 100 is mounted over the small girder bracket 300, through mounting holes. It is understood that the screws for fixing the hanger bracket 100 to the perpendicular beams 400, 500 could be replaced with any fixing means that serve this function, for example bolts or nails.

Once the hanger bracket 100 is mounted to the perpendicular beams 400, 500, the skewed beam 600 can be placed on the supporting section 120 of the hanger bracket 100, providing vertical support to the skewed beam 600. The skewed beam 600 can be permanently secured to the hanger bracket 100 by screws 700 through securing holes 122 in the supporting section 120 or securing holes 122 in the reinforcing faces 130, 132. Alternatively, the skewed beam 600 can be permanently secured to the hanger bracket 100 by screws 700 through securing holes 122 in the supporting section 120 and securing holes 122 in the reinforcing faces 130, 132.

As discussed, the reinforcing faces 130, 132 of the hanger bracket 100, which are inclined from the supporting section 120 to the fixing flanges 140, 142, may have securing holes 122 for securing the skewed beam 600 to the hanger bracket 100. The skewed beam 600 can be permanently fixed to the hanger bracket 100 by screws 700 which extend through the securing holes 122 in the reinforcing faces 130, 132. As the reinforcing faces 130, 132 are inclined, when the screws 700 are in their final position the heads of the screws 700 are also above the lowermost plane of the hanger bracket 100, and as a result will also be above the ceiling line and will not protrude into the plasterboard ceiling.

FIGS. 2*a* and 2*b* illustrate a blank 110 from which the hanger bracket 100 is formed. The blank 110 consists of five regions: the supporting section 120; two reinforcing faces 130, 132; and two fixing flanges 140, 142. The regions are denoted by bend/fold lines 114, 115, 116, 117. Bend line 114 and bend line 115 are on opposite sides of the supporting section 120, bend line 114 and bend line 116 are on opposite sides of the first reinforcing face 130, and bend line 115 and bend line 117 are on opposite sides of the second reinforcing face 132. The holes 122, 144 can be either formed at the same time as the blank 110, or can be punched, drilled or lasered, or the like, once the blank is formed.

The blank 110 can be made out of sheet metal; however it could also be made of other materials. Preferably the blank 110, and the holes 122, 144, are stamped from sheet metal that is between 1 mm to 3 mm thick. It is, however, understood that other methods of manufacturing, such as laser cutting, and/or using another thicknesses of material would be capable of providing a similar outcome without moving away from the scope of the current invention.

As will be clear, the positions at which the bend lines 114, 115, 116, 117 are placed, and the angle at which the reinforcing faces 130, 132 and fixing flanges 140, 142 are bent, will be directly related to the specific design. In this embodiment the reinforcing faces 130, 132 are substantially triangular with the supporting section 120 connected along one side of the triangle and a fixing flange 140, 142 connected along another side of the triangle. An inclination angle $\alpha$ of 45° is considered 'ideal', however, various constraints will affect the angle that is chosen for a specific hanger bracket 100. . However, it is understood that, depending on the shape of reinforcing faces 130, 132, the inclination angle between the reinforcing faces 130, 132 and the supporting section 120 could range from anywhere between 5° and 85°, and more preferably between 30° and 60°.

While the embodiment of the hanger bracket 100 shown in the figures is designed for a skewed beam 600 at an angle of 45°, it can accommodate a limited range of skewed angles either side of 45°. It is also understood that if a skewed beam 600 is required to be mounted at an angle other than substantially 45° the bend lines 114, 115, 116, 117, and the angle at which the reinforcing faces 130, 132 and fixing flanges 140, 142 are bent, may be modified to accommodate a skewed beam at the desired angle.

Referring to FIG. 1, the hanger bracket 100 is formed by folding the blank 110 at bend lines 114, 115, 116, 117. The bend lines 114, 115, 116, 117 are positioned such that when folded the supporting section 120, the first fixing flange 140, and the second fixing flange 142, are perpendicular to each other, that is, the face of each is perpendicular to the other two faces.

From the foregoing, it is evident that the present invention provides a bracket, for mounting a skewed beam, including trusses, at a junction of two beams, which is less likely to deflect under the weight of the skewed beam.

Furthermore, it is evident that the present invention may also provide the ability to mount a skewed beam, including trusses, at a junction of two beams, using a hanger bracket that allows the fasteners securing the skewed beam to be attached above the ceiling line.

It will be understood to persons skilled in the art of the invention that many modifications may be made without departing from the spirit and scope of the invention. As various changes could be made in the above constructions without departing from the scope of the invention, it is intended that all matter contained in the above description and shown in the accompanying drawings shall be interpreted as illustrative and not in a limiting sense.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A hanger bracket for mounting a skewed beam at a junction of two adjacent beams, comprising;

a supporting section configured to support the skewed beam;

fixing flanges substantially perpendicular to the supporting section configured for attaching the bracket to the adjacent beams along surfaces of the fixing flanges positioned to engage respective ones of the adjacent beams when attached thereto, the surfaces defining planes that are non-parallel and non-coincident with each other, and holes in each of the fixing flanges, the holes extending through the planes of the fixing flanges;

reinforcing faces located between the supporting section and each of the fixing flanges, wherein the reinforcing faces are inclined relative to the supporting section and fixing flanges, the reinforcing faces being inclined at an angle between 30 and 60 degrees relative to the supporting section; and holes in at least one of the supporting section and the reinforcing faces configured to receive fasteners to secure the skewed beam to the hanger bracket.

2. The hanger bracket as set forth in claim 1, wherein the reinforcing faces are structured to bear the load of the skewed beam.

3. The hanger bracket as set forth in claim 1, wherein the reinforcing faces form a diagonal inclination between the support section and the fixing flanges.

4. The hanger bracket as set forth in claim 1, wherein the reinforcing faces are inclined at obtuse angles relative to the supporting section and fixing flanges.

5. The hanger bracket as set forth in claim 1, wherein the supporting section has one or more holes configured to receive fasteners to secure the skewed beam to the hanger bracket.

6. The hanger bracket as set forth in claim 1, wherein the reinforcing faces have one or more holes configured to receive fasteners to secure the skewed beam to the hanger bracket.

7. The hanger bracket as set forth in claim 1, wherein the supporting section defines a lowermost plane of the bracket and holes in the reinforcing faces are positioned above the lowermost plane.

8. The hanger bracket as set forth in claim 1, wherein each reinforcing face has a truncated triangular shape, whereby the supporting section is connected along one side of the truncated triangle and a fixing flange is connected along another side of the truncated triangle.

9. The hanger bracket as set forth in claim 1, wherein the fixing flanges have groups of fixing holes and each group corresponds to overlap with the fixing holes of different girder brackets, over which the hanger bracket can be fixed.

10. The hanger bracket as set forth in claim 1, wherein the hanger bracket is formed by folding a blank of sheet metal.

11. The hanger bracket as set forth in claim 1, wherein each reinforcing face extends upward from an edge of the supporting section, and each fixing flange extends upward from an edge of one of the reinforcing faces.

12. The hanger bracket as set forth in claim 1, wherein the reinforcing faces are inclined at a 45 degree angle relative to the supporting section.

13. A hanger bracket for mounting a skewed beam at a junction of two adjacent beams, comprising;

a supporting section configured to support the skewed beam;

fixing flanges substantially perpendicular to the supporting section configured for attaching the bracket to the adjacent beams, the fixing flanges lying in different planes to each other;

reinforcing faces located between the supporting section and each of the fixing flanges, wherein the reinforcing faces are inclined relative to the supporting section and fixing flanges, the reinforcing faces being inclined at an angle between 30 and 60 degrees relative to the supporting section; and the reinforcing faces having one or more holes configured to receive fasteners to secure the skewed beam to the hanger bracket.

14. The hanger bracket as set forth in claim 13, further comprising holes in the support section configured to receive fasteners to secure the skewed beam to the hanger bracket.

15. A hanger bracket for mounting a skewed beam at a junction of two adjacent beams, comprising;

a supporting section configured to support the skewed beam;

fixing flanges substantially perpendicular to the supporting section and substantially perpendicular to each other, the fixing flanges being configured for attaching the bracket to the adjacent beams along surfaces of the fixing flanges, and holes in each of the fixing flanges;

reinforcing faces located between the supporting section and each of the fixing flanges, wherein each reinforcing face is inclined relative to the supporting section and fixing flanges; and holes in at least one of the supporting section and the reinforcing faces configured to receive fasteners to secure the skewed beam to the hanger bracket;

wherein the supporting section comprises a four-sided plate including opposite parallel side edges, each reinforcing face comprising a four-sided plate and extending from one of the side edges of the supporting section, each reinforcing face comprising opposite non-parallel side edges and opposite lateral edges extending between the side edges, a first non-parallel side edge of each reinforcing face being connected to a respective side edge of the support section, and a second non-parallel side edge of the each reinforcing face connecting the reinforcing face to a respective fixing flange.

16. The hanger bracket as set forth in claim 15, wherein each fixing flange comprises a five-sided plate.

17. The hanger bracket as set forth in claim 16, wherein the supporting section is square.

* * * * *